US008617777B2

(12) United States Patent
Tanaka

(10) Patent No.: US 8,617,777 B2
(45) Date of Patent: Dec. 31, 2013

(54) ELECTROPHOTOGRAPHIC PHOTOSENSITIVE MEMBER, PROCESS CARTRIDGE AND ELECTROPHOTOGRAPHIC APPARATUS

(75) Inventor: Masato Tanaka, Tagata-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 499 days.

(21) Appl. No.: 12/851,935

(22) Filed: Aug. 6, 2010

(65) Prior Publication Data

US 2011/0045390 A1 Feb. 24, 2011

(30) Foreign Application Priority Data

Aug. 18, 2009 (JP) ..... 2009-189400
Aug. 3, 2010 (JP) ..... 2010-174522

(51) Int. Cl.
*G03G 5/047* (2006.01)

(52) U.S. Cl.
USPC ..... 430/59.1; 430/59.4; 399/159

(58) Field of Classification Search
USPC ..... 430/59.1, 83
See application file for complete search history.

(56) References Cited

U.S. PATENT DOCUMENTS 4,394,428 A * 7/1983 Van Allan et al. ..... 430/83
4,963,450 A 10/1990 Miyazaki et al. ..... 430/59
5,194,353 A 3/1993 Tanaka et al.
5,246,807 A 9/1993 Kanemaru et al.
5,405,724 A * 4/1995 Hsieh et al. ..... 430/58.8
5,453,342 A 9/1995 Go et al.
5,464,718 A 11/1995 Kashizaki et al.
5,527,653 A 6/1996 Tanaka
5,629,116 A 5/1997 Kashizaki et al.
5,666,589 A 9/1997 Yoshinaga et al.
5,811,212 A 9/1998 Tanaka
5,818,489 A 10/1998 Yoshinaga et al.
5,885,737 A 3/1999 Tanaka
6,040,100 A 3/2000 Tanaka et al.
6,139,997 A 10/2000 Tanaka et al.
6,183,922 B1 2/2001 Takai et al.
6,190,811 B1 2/2001 Tanaka et al.
6,218,063 B1 4/2001 Tanaka et al.
6,245,472 B1 6/2001 Tanaka
6,248,490 B1 6/2001 Suzuki et al.

(Continued)

FOREIGN PATENT DOCUMENTS

CN 101167022 A 4/2008
EP 0743561 A2 11/1996

(Continued)

OTHER PUBLICATIONS

Zhou et al.(Materials Chemistry and Physics 112 (2008) 577-579) published in 2008.*

(Continued)

*Primary Examiner* — Peter Vajda
*Assistant Examiner* — Olatunji Godo
(74) *Attorney, Agent, or Firm* — Fitzpatrick, Cella, Harper & Scinto

(57) ABSTRACT

An electrophotographic photosensitive member having a support and a photosensitive layer formed on the support, wherein the photosensitive layer contains a boron complex which is a product of the reaction of a compound having a phenolic hydroxyl group and a carbonyl group with a boron halide. Also disclosed are a process cartridge and an electrophotographic apparatus which have such an electrophotographic photosensitive member.

8 Claims, 1 Drawing Sheet

(56) References Cited

U.S. PATENT DOCUMENTS

| | | | | |
|---|---|---|---|---|
| 6,270,936 | B1 | 8/2001 | Tanaka et al. | |
| 6,335,132 | B1 | 1/2002 | Tanaka et al. | |
| 6,472,524 | B2 | 10/2002 | Tanaka | |
| 6,683,175 | B2 | 1/2004 | Tanaka | |
| 6,773,856 | B2 | 8/2004 | Tanaka et al. | |
| 6,833,227 | B2 | 12/2004 | Tanaka | |
| 7,245,851 | B2 | 7/2007 | Fujii et al. | |
| 7,276,318 | B2 | 10/2007 | Fujii et al. | |
| 7,333,752 | B2 | 2/2008 | Kawahara et al. | |
| 7,517,626 | B2 | 4/2009 | Fujii et al. | |
| 2009/0123176 | A1 | 5/2009 | Tanaka et al. | |
| 2009/0208247 | A1 | 8/2009 | Tanaka et al. | |
| 2009/0232551 | A1 * | 9/2009 | Nagao et al. | 399/159 |

FOREIGN PATENT DOCUMENTS

| | | | |
|---|---|---|---|
| JP | 59-031962 | | 2/1984 |
| JP | 01-183663 | | 7/1989 |
| JP | 09-034149 | | 2/1997 |
| JP | 10-067946 | | 3/1998 |
| WO | WO 2007078006 | * | 7/2007 |

OTHER PUBLICATIONS

Chinese Office Action dated Nov. 30, 2011 in Chinese Application No. 201010259072.X.

David W. Boykin et al., "170 and 11B NMR Spectroscopic Study of Substituted Benzo[d]-2, 2-difluoro-1, 3, 2-oxoniaoxaboratins," Heteroatom Chemistry, vol. 6, No. 5, pp. 397-401 (1995).

* cited by examiner

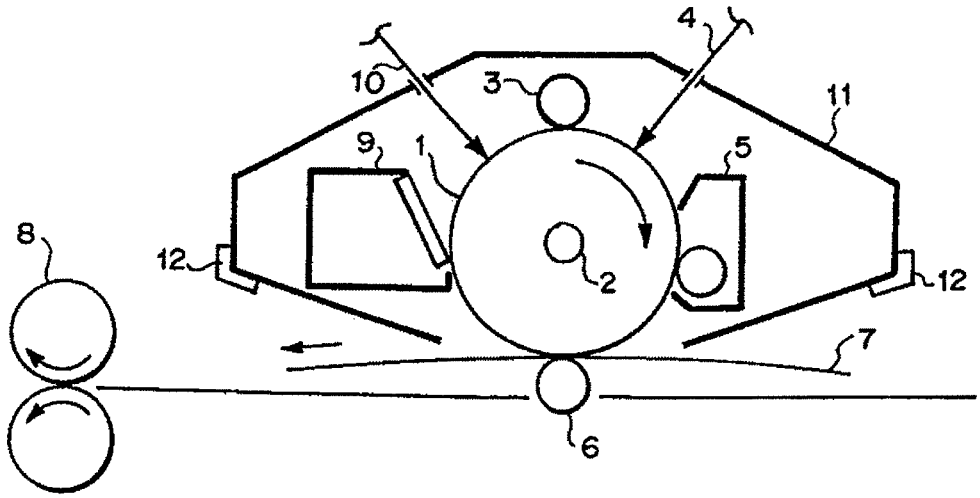
4
10
3
11
9
1
5
8
12
2
12
7
6

ELECTROPHOTOGRAPHIC PHOTOSENSITIVE MEMBER, PROCESS CARTRIDGE AND ELECTROPHOTOGRAPHIC APPARATUS

BACKGROUND OF THE INVENTION

1. Field of the Invention

This invention relates to an electrophotographic photosensitive member, and a process cartridge and an electrophotographic apparatus which have the electrophotographic photosensitive member.

2. Description of the Related Art

Electrophotographic photosensitive members used in electrophotographic apparatus such as copying machines and laser beam printers are required to have a sufficient sensitivity to imagewise exposure light, and the development of techniques for improving in sensitivity of electrophotographic photosensitive members has been being put forward. Techniques for improving in sensitivity of electrophotographic photosensitive members by using highly sensitive charge generating materials such as azo pigments and phthalocyanine pigments in photosensitive layers of electrophotographic photosensitive members are disclosed in Japanese Patent Applications Laid-open No. S59-31962, No. H01-183663, No. H10-67946 and No. H09-34149.

However, with such improvement in sensitivity of electrophotographic photosensitive members, electric charges (photocarriers) formed more tend to remain in the photosensitive layer to tend to cause variations in potential as a sort of memory.

Stated specifically, light-area potential and residual potential tend to come to decrease at the time of continuous printing. For example, where an electrophotographic photosensitive member is used in a development process in which the part of dark-area potential is made to serve as non-development part and the part of light-area potential as development part (what is called a reversal-development system), the areas to which the imagewise exposure light has been applied at the time of earlier printing come good in sensitivity. Hence, what is called positive ghost may unwantedly appear, which is a phenomenon that the part exposed to imagewise exposure light at the time of earlier printing appears indistinctly in black when a whole-area white image is reproduced at the time of next printing. Conversely, the light-area potential tends to come to increase at the initial stage of printing. For example, where the electrophotographic photosensitive member is used in the reversal-development system, the areas to which the imagewise exposure light has been applied at the time of earlier printing come poor in sensitivity. Hence, what is called negative ghost may unwantedly appear, which is a phenomenon that the part exposed to imagewise exposure light at the time of earlier printing appears indistinctly in white when a whole-area black image is reproduced at the time of next printing.

In particular, where an intermediate layer having a barrier function and so forth is provided between a support and a photosensitive layer, the intermediate layer has so high volume resistivity in a low-temperature and low-humidity environment that the electric charges may tend to remain in the photosensitive layer to tend to make the ghost phenomenon occur conspicuously.

SUMMARY OF THE INVENTION

An object of the present invention is to provide an electrophotographic photosensitive member that can make the ghost phenomenon not easily occur, and a process cartridge and an electrophotographic apparatus which have such an electrophotographic photosensitive member.

The present invention is an electrophotographic photosensitive member which has a support and a photosensitive layer formed on the support, wherein the photosensitive layer contains a boron complex which is a product of the reaction of a compound having a phenolic hydroxyl group and a carbonyl group with a boron halide.

The present invention is also a process cartridge which integrally supports the above electrophotographic photosensitive member and at least one means selected from the group consisting of a charging means for charging the surface of the electrophotographic photosensitive member electrostatically, a developing means for developing with a toner an electrostatic latent image formed on the surface of the electrophotographic photosensitive member, to form a toner image on the surface of the electrophotographic photosensitive member, and a cleaning means for removing the toner remaining on the surface of the electrophotographic photosensitive member after the toner image has been transferred, and is detachably mountable to the main body of an electrophotographic apparatus.

The present invention is still also an electrophotographic apparatus which comprises the above electrophotographic photosensitive member, a charging means for charging the surface of the electrophotographic photosensitive member electrostatically, an imagewise exposure means for exposing to imagewise exposure light the surface of the electrophotographic photosensitive member thus charged, to form an electrostatic latent image on the surface of the electrophotographic photosensitive member, a developing means for developing with a toner an electrostatic latent image formed on the surface of the electrophotographic photosensitive member, to form a toner image on the surface of the electrophotographic photosensitive member, and a transfer means for transferring to a transfer material the toner image formed on the surface of the electrophotographic photosensitive member.

According to the present invention, it can provide an electrophotographic photosensitive member that can make the ghost phenomenon not easily occur, and a process cartridge and an electrophotographic apparatus which have such an electrophotographic photosensitive member.

Further features of the present invention will become apparent from the following description of exemplary embodiments with reference to the attached drawings.

BRIEF DESCRIPTION OF THE DRAWING

The FIGURE is a view showing schematically an example of the construction of an electrophotographic apparatus having a process cartridge provided with the electrophotographic photosensitive member of the present invention.

DESCRIPTION OF THE EMBODIMENTS

Preferred embodiments of the present invention will now be described in detail in accordance with the accompanying drawings.

The boron complex used in the present invention is a product of the reaction of a compound having a phenolic hydroxyl group and a carbonyl group with a boron halide. The phenolic hydroxyl group is a hydroxyl group standing bonded to a benzene ring. Also, the boron halide is a compound represented by $BX_3$ (wherein the three X's each independently represent a halogen atom).

The boron complex may preferably be a compound having a partial structure represented by the following structural formula (ps).

(ps)

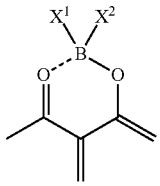

In the structural formula (ps), $X^1$ and $X^2$ each independently represent a halogen atom.

The partial structure represented by the structural formula (ps) is a partial structure formed by the phenolic hydroxyl group and carbonyl group in the compound having a phenolic hydroxyl group and a carbonyl group, which is a raw material for the boron complex, and the boron atom in the boron halide, which is also a raw material for the boron complex.

The halogen atom represented by $X^1$ and $X^2$ in the structural formula (ps) may include, e.g., a fluorine atom, a chlorine atom and a bromine atom. Of these, a fluorine atom is preferred.

The boron halide may preferably be boron trifluoride ($BF_3$).

From the viewpoint of more keeping the ghost phenomenon from occurring, the boron complex may also preferably be a compound represented by any of the following general formulas (1) to (5).

(1)

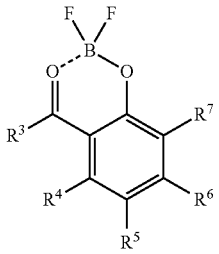

(2)

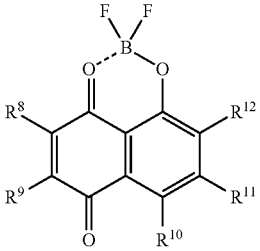

(3)

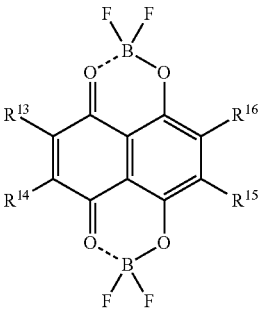

-continued (4)

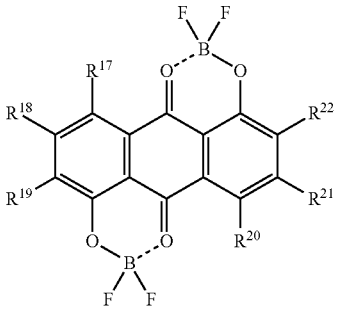

(5)

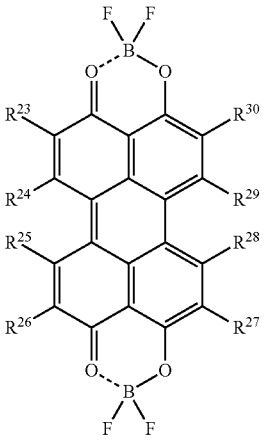

In the general formulas (1) to (5), $R^3$ to $R^{30}$ each independently represent a hydrogen atom, a halogen atom, a nitro group, a hydroxyl group, an alkyl group, an alkoxyl group, a phenyl group or a tolyl group. Besides, $R^4$ to $R^{30}$ may combine with another adjacent group among $R^4$ to $R^{30}$ to form a divalent group represented by —CH═CH—CH═CH—.

The halogen atom represented by $R^3$ to $R^{30}$ in the general formulas (1) to (5) may include, e.g., a fluorine atom, a chlorine atom and a bromine atom, and, of these, a bromine atom is preferred. Also, the alkyl group represented by $R^3$ to $R^{30}$ in the general formulas (1) to (5) may include, e.g., a methyl group, an ethyl group, a propyl group and a butyl group, and, of these, a methyl group is preferred. Still also, the alkoxyl group represented by $R^3$ to $R^{30}$ in the general formulas (1) to (5) may include, e.g., a methoxyl group, an ethoxyl group, a propoxyl group and a butoxyl group, and, of these, a methoxyl group is preferred.

The compound in the case when $R^4$ to $R^{30}$ in the general formulas (1) to (5) combine with another adjacent group among $R^4$ to $R^{30}$ to form a divalent group represented by —CH═CH—CH═CH— may include as its specific examples Exemplary Compounds (3), (7), (8), (10), (12), (23) and (31), which are as shown later.

Exemplary Compound (3) corresponds to the compound represented by the general formula (1), where $R^4$ in the general formula (1) combines with its adjacent group $R^5$ to form the divalent group represented by —CH═CH—CH═CH—. Thus, the group —CH═CH—CH═CH— formed by combination of $R^4$ and $R^5$ and the carbon atoms to which $R^4$ and $R^5$ in the general formula (1) respectively stand bonded form a benzene ring.

Exemplary Compounds (7), (8) and (31) each correspond to the compound represented by the general formula (2), where $R^8$ in the general formula (2) combines with its adjacent group $R^9$ to form the divalent group represented by —CH═CH—CH═CH—. Thus, the group —CH═CH—CH═CH— formed by combination of $R^8$ and $R^9$ and the carbon atoms to which $R^8$ and $R^9$ in the general formula (2) respectively stand bonded form a benzene ring.

Exemplary Compound (10) corresponds to the compound represented by the general formula (3), where $R^{13}$ in the general formula (3) combines with its adjacent group $R^{14}$ to form the divalent group represented by —CH═CH—CH═CH—. Thus, the group —CH═CH—CH═CH— formed by combination of $R^{13}$ and $R^{14}$ and the carbon atoms to which $R^{13}$ and $R^{14}$ in the general formula (3) respectively stand bonded form a benzene ring.

Exemplary Compound (12) also corresponds to the compound represented by the general formula (3), where $R^{13}$ in the general formula (3) combines with its adjacent group $R^{14}$ to form the divalent group represented by —CH═CH—CH═CH—. Thus, the group —CH═CH—CH═CH— formed by combination of $R^{13}$ and $R^{14}$ and the carbon atoms to which $R^{13}$ and $R^{14}$ in the general formula (3) respectively stand bonded form a benzene ring. Further, in Exemplary Compound (12), $R^{15}$ in the general formula (3) also combines with its adjacent group $R^{16}$ to form the divalent group represented by —CH═CH—CH═CH—. Thus, the group —CH═CH—CH═CH— formed by combination of $R^{15}$ and $R^{16}$ and the carbon atoms to which $R^{15}$ and $R^{16}$ in the general formula (3) respectively stand bonded form a benzene ring.

Exemplary Compound (23) corresponds to the compound represented by the general formula (1), where $R^6$ in the general formula (1) combines with its adjacent group $R^7$ to form the divalent group represented by —CH═CH—CH═CH—. Thus, the group —CH═CH—CH═CH— formed by combination of $R^6$ and $R^7$ and the carbon atoms to which $R^6$ and $R^7$ in the general formula (1) respectively stand bonded form a benzene ring.

As in the above, "adjacent" means that the carbon atoms in the general formulas to which the respective R's ($R^4$ to $R^{30}$) stand bonded are adjacent to each other (directly bonded).

Of the above compounds, from the viewpoint of more keeping the ghost phenomenon from occurring, the compound represented by the general formula (1) is preferred and, in particular, more preferred is the compound in which $R^3$ in the general formula (1) is a phenyl group.

Specific examples (Exemplary Compounds) of the boron complex used in the present invention are shown in Table 1 to 4, by which, however, the present invention is by no means limited.

TABLE 1

| Exemplary Compound | |
|---|---|
| (1) | 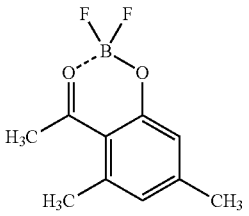 |

TABLE 1-continued

| Exemplary Compound | |
|---|---|
| (2) | 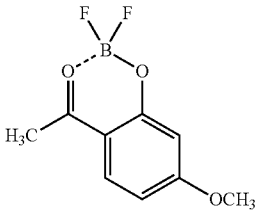 |
| (3) | 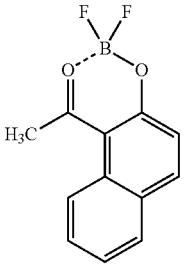 |
| (4) | 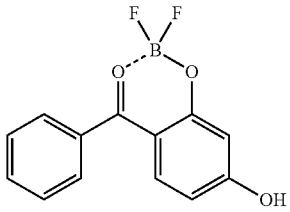 |
| (5) | 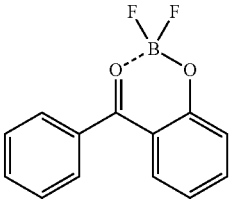 |
| (6) | 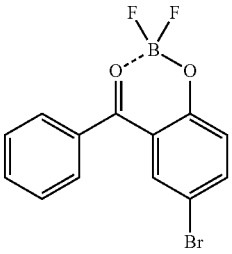 |
| (7) | 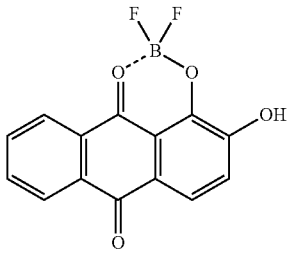 |

TABLE 1-continued
| Exemplary Compound | |
|---|---|
| (8) | 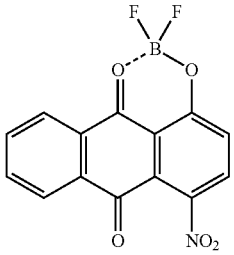 |
| (9) | 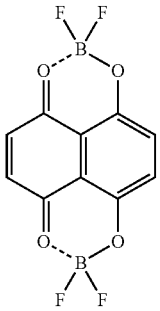 |
| (10) | 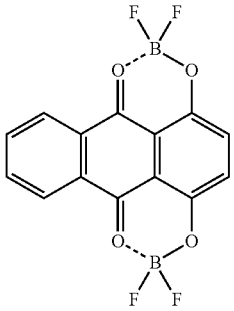 |
TABLE 2
| Exemplary Compound | |
|---|---|
| (11) | 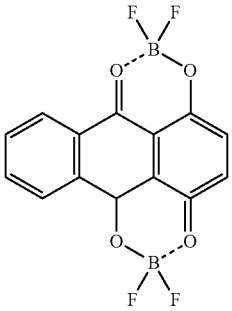 |
TABLE 2-continued
| Exemplary Compound | |
|---|---|
| (12) | 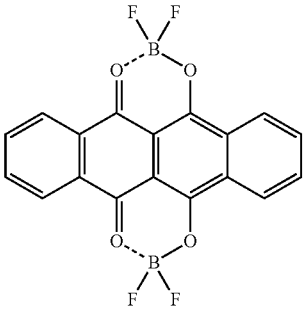 |
| (13) | 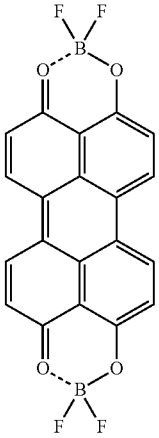 |
TABLE 3
| Exemplary Compound | |
|---|---|
| (14) | 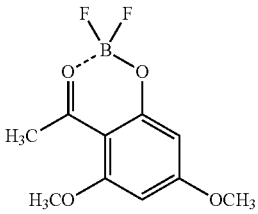 |
| (15) | 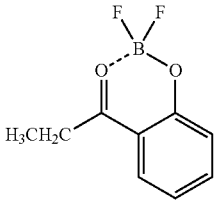 |
| (16) | 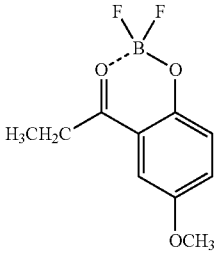 |

TABLE 3-continued
| Exemplary Compound | |
|---|---|
| (17) | 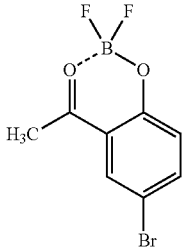 |
| (18) | 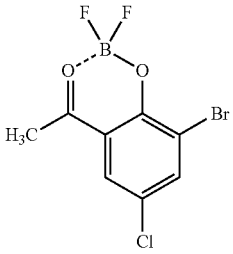 |
| (19) | 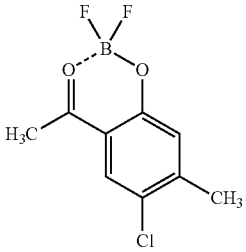 |
| (20) | 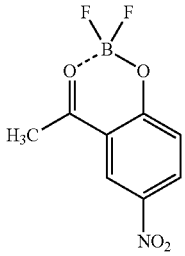 |
| (21) | 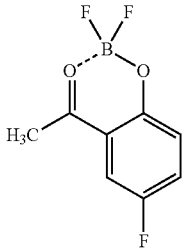 |
| (22) | 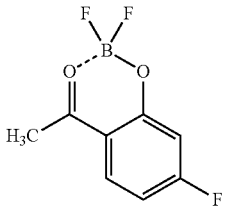 |
TABLE 3-continued
| Exemplary Compound | |
|---|---|
| (23) | 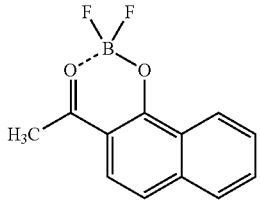 |
TABLE 4
| Exemplary Compound | |
|---|---|
| (24) | 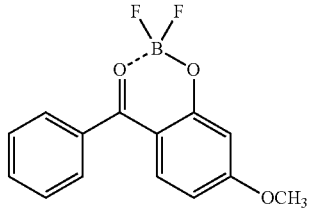 |
| (25) | 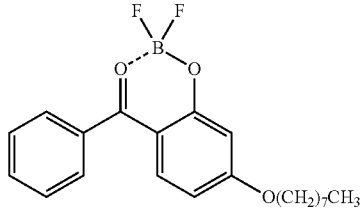 |
| (26) | 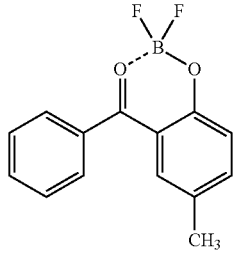 |
| (27) | 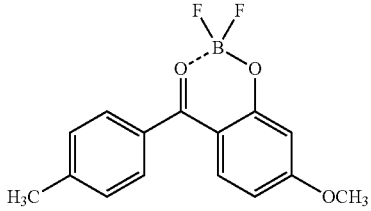 |
| (28) | 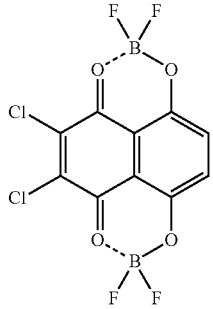 |

TABLE 4-continued

| Exemplary Compound |
|---|
| (29) 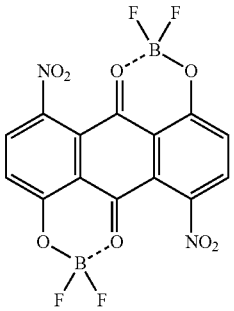 |
| (30) 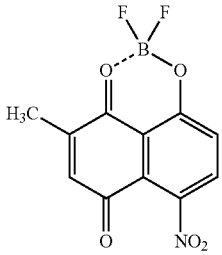 |
| (31) 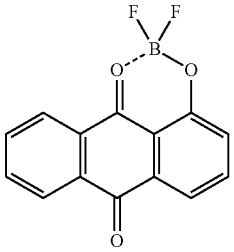 |

How to synthesize the boron complex used in the present invention is described below.

The above boron complex may be synthesized by allowing the compound having a phenolic hydroxyl group and a carbonyl group to react with the boron halide. Stated specifically, it may be synthesized by treating the compound having a phenolic hydroxyl group and a carbonyl group with a "boron trifluoride-ethyl ether complex" according to Heteroatom Chemistry, Vol. 6, No. 5, pp. 397-401 (1995).

"%" and "part(s)" shown below are meant by "% by mass" and "part(s) by mass", respectively. Mass spectrometric analysis is made by using Trace DSQ-MASS-SPECTROMETER (trade name), manufactured by Thermo Electron Corporation. Measurement by IR (infrared spectrometry) is also made by using FT/IR-420 (trade name), manufactured by JASCO Corporation. Measurement by NMR (nuclear magnetic resonance spectroscopy) is also made by using EX-400 (trade name), manufactured by JROL Ltd.

Synthesis Example 1

Synthesis of Exemplary Compound (4)

In an atmosphere of nitrogen, 5.0 parts of 2,4-dihydroxybenzophenone and 100 parts of chloroform (amylene-loaded product) were put into a three-necked flask, and the 2,4-dihydroxybenzophenone was dissolved at room temperature. Into the solution formed, 4.0 parts of 47% boron trifluoride etherate was poured, and thereafter reflux was carried out for 5 hours. Next, this was cooled to room temperature, and thereafter 100 parts of n-hexane was added thereto. Crystals precipitated were collected by filtration, and the crystals were washed with n-hexane on a filter (filtering device), followed by drying under reduced pressure at 30° C. to obtain 5.2 parts of pale-yellow crystals Exemplary Compound (4).

Values of mass spectrometric analysis, characteristic peaks obtained by IR spectrometry and also NMR data are shown below.

MS (direct probe): 262.02 Calculated exact mass: 262.06 IR ($cm^{-1}$, KBr): 3399, 1617, 1399, 1026, 858, 701 $^1$H-NMR (ppm, $CDCl_3$, 40° C.): δ=7.83 (d, 2H, J=7.32 Hz) 7.73 (t, 1H) 7.63-7.57 (m, 3H) 6.60 (s, 1H) 6.59 (d, 1H) 1.82 (brs, 1H)

Synthesis Example 2

Synthesis of Exemplary Compound (5)

In an atmosphere of nitrogen, 2.0 parts of 2-hydroxybenzophenone and 20 parts of chloroform (amylene-loaded product) were put into a three-necked flask, and the 2-hydroxybenzophenone was dissolved at room temperature. Into the solution formed, 2.2 parts of boron trifluoride etherate was poured, and thereafter these were stirred for 13 hours. Next, the solvent was evaporated off, and then crystals precipitated were dispersedly washed with 100 parts of n-hexane. Thereafter, the crystals were collected by filtration, and further the crystals were washed with n-hexane on a filter (filtering device), followed by drying under reduced pressure at 30° C. to obtain 2.5 parts of pale-yellow crystals Exemplary Compound (5).

Values of mass spectrometric analysis, characteristic peaks obtained by IR spectrometry and also NMR data are shown below.

MS (direct probe): 246.04 Calculated exact mass: 246.07 IR ($cm^{-1}$, KBr): 1617, 1560, 1519, 1473, 1385, 1068, 699 $^1$H-NMR (ppm, $CDCl_3$, 40° C.): δ=7.90 (d, 2H, J=7.57 Hz) 7.85-7.78 (m, 2H) 7.73 (dd, 1H) 7.62 (t, 2H) 7.20 (d, 1H, J=8.79 Hz) 7.07 (t, 1H)

Synthesis Example 3

Synthesis of Exemplary Compound (11)

In an atmosphere of nitrogen, 2.4 parts of 1,5-dihydroxyanthraquinone and 350 parts of chloroform (amylene-loaded product) were put into a three-necked flask. Into it, 4.3 parts of boron trifluoride etherate was poured, and thereafter reflux was carried out for 20 hours. Crystals were collected by filtration, and the crystals were washed with chloroform (amylene-loaded product) on a filter (filtering device), followed by drying under reduced pressure at 30° C. to obtain 3.0 parts of dark-brown crystals Exemplary Compound (11).

Values of mass spectrometric analysis, characteristic peaks obtained by IR spectrometry and also NMR data are shown below.

MS (direct probe): 336.01 Calculated exact mass: 336.04 IR ($cm^{-1}$, KBr): 1599, 1527, 1491, 1441, 1295, 1028, 709 $^1$H-NMR (ppm, $CDCl_3$, 40° C.): δ=7.85 (d, 2H, J=7.57 Hz) 7.69 (t, 2H) 7.32 (d, 2H, J=8.55 Hz)

The photosensitive layer of the electrophotographic photosensitive member of the present invention, which layer contains the above boron complex, may be incorporated with a phthalocyanine pigment or an azo pigment as a charge generating material. This is preferable from the viewpoint of improvement in sensitivity of the electrophotographic photosensitive member. Of these, a phthalocyanine pigment is preferred.

As the phthalocyanine pigment, any phthalocyanine pigment may be used, such as metal-free phthalocyanine and metal phthalocyanines which may have an axial ligand. Such phthalocyanine pigments may also be those each having a substituent. Of the phthalocyanine pigments, in particular, an oxytitanium phthalocyanine and a gallium phthalocyanine are highly sensitive charge generating materials on the one hand, but on the other hand tend to cause the ghost phenomenon, and hence the present invention acts especially effectively.

The phthalocyanine pigment may have any crystal form. In particular, hydroxygallium phthalocyanine crystals with a crystal form having peaks at 7.4°±0.3° and 28.2°±0.3° of the Bragg's angle 2θ in CuKα characteristic X-ray diffraction, chlorogallium phthalocyanine crystals with a crystal form having peaks at 7.4°, 16.6°, 25.5° and 28.3° of the Bragg's angle 2θ±0.2° in CuKα characteristic X-ray diffraction, and oxytitanium phthalocyanine crystals with a crystal form having a peak at 27.2±0.2° of the Bragg's angle 2θ in CuKα characteristic X-ray diffraction are preferred. Of these, the hydroxygallium phthalocyanine crystals with a crystal form having peaks at 7.4°±0.3° and 28.2°±0.2° of the Bragg's angle 2θ in CuKα characteristic X-ray diffraction are preferred. Further in particular, hydroxygallium phthalocyanine crystals with a crystal form having peaks at 7.3°, 24.9° and 28.1° of the Bragg's angle 2θ±0.2° in CuKα characteristic X-ray diffraction and in which the peak at 28.1° is the strongest peak, and hydroxygallium phthalocyanine crystals with a crystal form having peaks at 7.5°, 9.9°, 16.3°, 18.6°, 25.1° and 28.3° of the Bragg's angle 2θ±0.2° in CuKα characteristic X-ray diffraction are more preferred.

The electrophotographic photosensitive member of the present invention is, as mentioned above, the electrophotographic photosensitive member which has a support and a photosensitive layer formed on the support.

The photosensitive layer is roughly classified into a single-layer type photosensitive layer containing the above boron complex, a charge-generating material and a charge-transporting material in a single layer, and a multi-layer type photosensitive layer formed in layers of a charge generation layer containing the above boron complex and a charge-generating material and a charge transport layer containing a charge-transporting material. Of these, the multi-layer type photosensitive layer is preferred. Also, in regard to the relation of superposing the charge generation layer and the charge transport layer, it is preferable that the charge generation layer is on the support side.

The support may be any of those having conductivity (conductive supports) and may include, e.g., supports made of metals such as aluminum and stainless steel, and supports made of metals, plastics or papers provided with conductive coatings on their surfaces. The support may also be in the form of, e.g., a cylinder or a film.

An intermediate layer having a barrier function and an adhesion function may also be provided between the support and the photosensitive layer. The intermediate layer may be formed by coating an intermediate layer coating solution prepared by dissolving polyvinyl alcohol, polyethylene oxide, ethyl cellulose, methyl cellulose, casein, polyamide, glue or gelatin in a solvent, and then drying the wet coating formed.

The intermediate layer may preferably be in a layer thickness of from 0.2 μm to 3.0 μm.

Between the support and the intermediate layer, a conductive layer may also be provided so that any unevenness or defects on the support can be covered and interference fringes can be prevented.

The conductive layer may be formed by coating a conductive layer coating dispersion prepared by subjecting conductive particles such as carbon black, metal particles or metal oxide particles to dispersion treatment together with a binder resin and a solvent, and then drying the wet coating formed.

The conductive layer may preferably be in a layer thickness of from 5 μm to 40 μm, and particularly preferably from 10 μm to 30 μm.

The photosensitive layer is formed on the support (or on the conductive layer or intermediate layer).

Where the photosensitive layer is the single-layer type photosensitive layer, the single-layer type photosensitive layer may be formed by coating a single-layer type photosensitive layer coating dispersion prepared by subjecting the boron complex, the charge-generating material and a charge-transporting material to dispersion treatment together with a binder resin and a solvent, and then drying the wet coating formed.

Where the photosensitive layer is the multi-layer type photosensitive layer, the charge generation layer may be formed by coating a charge generation layer coating dispersion prepared by subjecting the boron complex and the charge-generating material to dispersion treatment together with a binder resin and a solvent, and then drying the wet coating formed. The charge transport layer may also be formed by coating a charge transport layer coating solution prepared by dissolving a charge-transporting material and a binder resin in a solvent, and then drying the wet coating formed.

The charge-transporting material may include, e.g., triarylamine compounds, hydrazone compounds, stilbene compounds, pyrazoline compounds, oxazole compounds, thiazole compounds and triarylmethane compounds. Of these, as a charge-transporting material used in combination with the boron complex, a triarylamine compound is preferred.

The binder resin used to form the above respective layers may include, e.g., polyester, acrylic resins, polyvinyl carbazole, phenoxy resins, polycarbonate, polyvinyl butyral, polystyrene, polyvinyl acetate, polysulfone, polyarylate, vinylidene chloride, acrylonitrile copolymers and polyvinyl benzal. Of these, as a resin in which the boron complex is to be dispersed, polyvinyl butyral or polyvinyl benzal is preferred.

Where the photosensitive layer is the single-layer type photosensitive layer, the single-layer type photosensitive layer may preferably be in a layer thickness of from 5 μm to 40 μm, and much preferably from 10 μm to 30 μm.

Where the photosensitive layer is the multi-layer type photosensitive layer, the charge generation layer may preferably be in a layer thickness of from 0.01 μm to 10 μm, and much preferably from 0.05 μm to 5 μm. The charge transport layer may also preferably be in a layer thickness of from 5 μm to 40 μm, and much preferably from 10 μm to 30 μm.

Where the photosensitive layer is the single-layer type photosensitive layer, the boron complex in the single-layer type photosensitive layer may preferably be in a content of from 0.00001% by mass to 1% by mass based on the total mass of the single-layer type photosensitive layer. The charge-generating material in the single-layer type photosensitive layer may preferably be in a content of from 3% by mass to 30% by mass based on the total mass of the single-layer type photosensitive layer. The charge-transporting material in the single-layer type photosensitive layer may also preferably be in a content of from 30% by mass to 70% by mass based on the total mass of the single-layer type photosensitive layer.

Where the photosensitive layer is the multi-layer type photosensitive layer, the boron complex may preferably be incorporated in the charge generation layer, and the boron complex in the charge generation layer may preferably be in a content of from 0.0001% by mass to 20% by mass, and much preferably from 0.001% by mass to 10% by mass, based on the total mass of the charge generation layer. The charge-generating material in the charge generation layer may preferably be in a content of from 30% by mass to 90% by mass, and much preferably from 50% by mass to 80% by mass, based on the total mass of the charge generation layer. The charge-transporting material in the charge transport layer may preferably be in a content of from 20% by mass to 80% by mass, and much preferably from 30% by mass to 70% by mass, based on the total mass of the charge transport layer.

In any cases, the boron complex in the photosensitive layer (or the charge generation layer in the case when the photosensitive layer is the multi-layer type photosensitive layer) may preferably be in a content of from 0.1% by mass to 10% by mass, much preferably from 0.2% by mass to 5% by mass, and much more preferably from 0.5% by mass to 5% by mass, based on the charge-generating material in the photosensitive layer (or the charge generation layer).

On the photosensitive layer, a protective layer may be provided for the purpose of protecting the photosensitive layer.

The protective layer may be formed by coating a protective layer coating solution prepared by dissolving in a solvent a resin such as polyvinyl butyral, polyester, polycarbonate (polycarbonate Z or modified polycarbonate), nylon, polyimide, polyarylate, polyurethane, a styrene-butadiene copolymer, a styrene-acrylic acid copolymer or a styrene-acrylonitrile copolymer, and then drying the wet coating formed. Also, after the protective layer coating solution has been coated, the wet coating formed may be cured by heat, electron rays, ultraviolet rays or the like to form the protective layer.

The protective layer may preferably be in a layer thickness of from 0.05 μm to 20 μm.

The protective layer may also be incorporated therein with conductive particles, an ultraviolet absorber or lubricating particles such as fluorine atom-containing resin particles. The conductive particles may include, e.g., metal oxide particles such as tin oxide particles.

The above respective layers may be coated by using a coating method such as dip coating (dipping), spray coating, spinner coating, bead coating, blade coating and beam coating.

The crystal form of the boron complex may be amorphous or may be crystalline. The boron complex may also be used in combination of two or more types.

FIG. 1 is a view showing schematically the construction of an electrophotographic apparatus having a process cartridge provided with the electrophotographic photosensitive member of the present invention.

In FIG. 1, reference numeral 1 denotes a drum-shaped (cylindrical) electrophotographic photosensitive member of the present invention, which is rotatingly driven around an axis 2 in the direction of an arrow at a given peripheral speed (process speed). In the course of its rotation, the electrophotographic photosensitive member 1 is electrostatically charged on its surface (peripheral surface) to a positive or negative, given potential through a charging means 3. Then, the surface of the electrophotographic photosensitive member is exposed to imagewise exposure light 4 emitted from an exposure means (not shown). As the imagewise exposure light, it is, e.g., light shed by slit exposure, laser beam scanning exposure or the like and having been intensity-modulated correspondingly to time-sequential digital image signals of the intended image information. In this way, electrostatic latent images corresponding to the intended image information are successively formed on the surface of the electrophotographic photosensitive member 1.

The electrostatic latent images thus formed on the surface of the electrophotographic photosensitive member 1 are subsequently developed (by regular development or reverse development) with a toner held in a developing means 4, so that toner images are formed on the surface of the electrophotographic photosensitive member 1. Next, the toner images formed on the surface of the electrophotographic photosensitive member 1 are successively transferred by a transfer means 6, to a transfer material 7. At this point, bias voltage having a polarity reverse to that of the electric charges the toner has is applied to the transfer means 6 from a bias power source (not shown). Here, the transfer material 7 is taken out of a paper feed section (not shown) in the manner synchronized with the rotation of the electrophotographic photosensitive member 1, and fed to the part between the electrophotographic photosensitive member 1 and the transfer means 6.

The transfer material 7 to which the toner images have been transferred is separated from the surface of the electrophotographic photosensitive member 1, and is transported to an image fixing means 8. In the image fixing means 8, the toner images on the transfer material 7 are processed to be fixed, and is then delivered out of the electrophotographic apparatus as an image-formed material (a print or a copy).

The surface of the electrophotographic photosensitive member 1 from which the toner images have been transferred is brought to removal of any deposits such as transfer residual toner, through a cleaning means 9. Thus, the electrophotographic photosensitive member is cleaned on its surface. In recent years, a cleanerless system has also been brought out, where the transfer residual toner can directly be collected with a developing assembly or the like. Further, the surface of the electrophotographic photosensitive member 1 is subjected to charge elimination by pre-exposure light 10 emitted from a pre-exposure means (not shown), and thereafter repeatedly used for the formation of images. Incidentally, where the charging means 3 is a contact charging means making use of a charging roller, such pre-exposure need not necessarily be required.

In the present invention, some constituents among constituents selected from the above electrophotographic photosensitive member 1, the charging means 3, the developing means 5, the cleaning means 9 and so forth may be so received in a container as to be integrally supported to form a process cartridge, and this process cartridge may be so set up as to be detachably mountable to the main body of the electrophotographic apparatus. For example, the electrophotographic photosensitive member 1 and at least one means of the charging means 3, the developing means 5 and the cleaning means 9 may integrally be supported to form a cartridge to set up a process cartridge 11 detachably mountable to the main body of the electrophotographic apparatus through a guide means 12 such as rails provided in the main body of the electrophotographic apparatus.

Where the electrophotographic apparatus is a copying machine, the imagewise exposure light 4 may be light reflected from, or transmitted through, an original. Instead, it may also be light irradiated by the scanning of a laser beam, the driving of an LED array or the driving of a liquid crystal shutter array, performed by reading an original through a sensor and converting the information into signals and according to the signals thus obtained.

The present invention is described below in greater detail by giving Examples. Note, however, that embodiments of the present invention are by no means limited to these. Here, "%" and "part(s)" in Examples are meant by "% by mass" and "part(s) by mass", respectively, unless particularly noted. Also, layer thickness shown in Examples and Comparative Examples is found by using an eddy current layer thickness meter (trade name: FISCHERSCOPE, manufactured by Fisher Instruments Co.), or by the conversion of specific gravity from mass per unit area.

Example 1

An aluminum cylinder of 30 mm in diameter and 260.5 mm in length was used as a support (a cylindrical conductive support).

50 parts of titanium oxide particles coated with tin oxide containing 10% of antimony oxide, 25 parts of resol type phenolic resin, 20 parts of methyl cellosolve, 5 parts of methanol and 0.002 part of silicone oil (a polydimethylsiloxane-polyoxyalkylene copolymer; weight average molecular weight: 3,000) were put into a sand mill making use of glass beads of 1 mm in diameter, and put to dispersion treatment for 2 hours to prepare a conductive layer coating dispersion. This conductive layer coating dispersion was dip-coated on the support, and then the wet coating formed was dried at 140° C. for 30 minutes to form a conductive layer with a layer thickness of 20 μm.

Next, 5 parts of a 6-66-610-12 polyamide quadripolymer was dissolved in a mixed solvent of 70 parts of methanol and 25 parts of butanol to prepare an intermediate layer coating solution. This intermediate layer coating solution was dip-coated on the conductive layer, and then the wet coating formed was dried to form an intermediate layer with a layer thickness of 1 μm.

Next, 10 parts of hydroxygallium phthalocyanine crystals (charge-generating material) with a crystal form having peaks at 7.5°, 9.9°, 16.3°, 18.6°, 25.1° and 28.3° of the Bragg's angle 2θ±0.2° in CuKα characteristic X-ray diffraction, 0.2 part of Exemplary Compound (4), 5 parts of polyvinyl butyral resin (trade name: S-LEC BX-1; available from Sekisui Chemical Co., Ltd.) and 250 parts of cyclohexanone were put into a sand mill making use of glass beads of 1 mm in diameter, and put to dispersion treatment for 1 hour. To the resultant system, 250 parts of ethyl acetate was added to dilute it to prepare a charge generation layer coating dispersion. This charge generation layer coating dispersion was dip-coated on the intermediate layer, and then the wet coating formed was dried at 100° C. for 10 minutes to form a charge generation layer with a layer thickness of 0.16 μm.

Next, 10 parts of a compound (charge-transporting material) represented by the following structural formula (ctm-1):

(ctm-1)

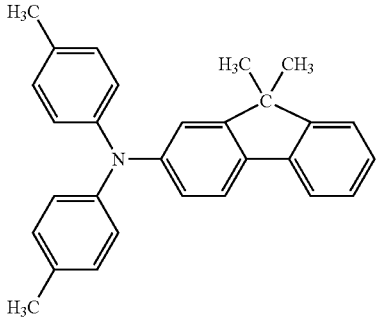

and 10 parts of polycarbonate resin (trade name: EUPILON Z-200; available from Mitsubishi Gas Chemical Company, Inc.) were dissolved in 70 parts of monochlorobenzene to prepare a charge transport layer coating solution. This charge transport layer coating solution was dip-coated on the charge generation layer, and then the wet coating formed was dried at 110° C. for 1 hour to form a charge transport layer with a layer thickness of 25 μm.

In this way, a drum-shaped (cylindrical) electrophotographic photosensitive member of Example 1 was produced, having the support and formed thereon the conductive layer, the intermediate layer, the charge generation layer and the charge transport layer.

Example 2

An electrophotographic photosensitive member of Example 2 was produced in the same way as in Example 1 except that, when in Example 1 the charge generation layer coating dispersion was prepared, the amount 0.2 part of Exemplary Compound (4) used was changed to 0.05 part.

Example 3

An electrophotographic photosensitive member of Example 3 was produced in the same way as in Example 1 except that, when in Example 1 the charge generation layer coating dispersion was prepared, the amount 0.2 part of Exemplary Compound (4) used was changed to 0.5 part.

Example 4

An electrophotographic photosensitive member of Example 4 was produced in the same way as in Example 1 except that, when in Example 1 the charge generation layer coating dispersion was prepared, the amount 0.2 part of Exemplary Compound (4) used was changed to 1.5 parts.

Example 5

An electrophotographic photosensitive member of Example 5 was produced in the same way as in Example 1 except that, when in Example 1 the charge generation layer coating dispersion was prepared, Exemplary Compound (4) used was changed for Exemplary Compound (5).

Example 6

An electrophotographic photosensitive member of Example 6 was produced in the same way as in Example 1 except that, when in Example 1 the charge generation layer coating dispersion was prepared, Exemplary Compound (4) used was changed for Exemplary Compound (7).

Example 7

An electrophotographic photosensitive member of Example 7 was produced in the same way as in Example 1 except that, when in Example 1 the charge generation layer coating dispersion was prepared, Exemplary Compound (4) used was changed for Exemplary Compound (10).

Example 8

An electrophotographic photosensitive member of Example 8 was produced in the same way as in Example 1 except that, when in Example 1 the charge generation layer coating dispersion was prepared, Exemplary Compound (4) used was changed for Exemplary Compound (11).

Example 9

An electrophotographic photosensitive member of Example 9 was produced in the same way as in Example 1 except that, when in Example 1 the charge generation layer coating dispersion was prepared, Exemplary Compound (4) used was changed for Exemplary Compound (9).

Example 10

An electrophotographic photosensitive member of Example 10 was produced in the same way as in Example 1 except that, when in Example 1 the charge generation layer coating dispersion was prepared, Exemplary Compound (4) used was changed for Exemplary Compound (13).

Example 11

The procedure of Example 1 was repeated to form on the support the conductive layer, the intermediate layer and the charge generation layer.

Next, 10 parts of a compound (charge-transporting material) represented by the following structural formula (ctm-2):

(ctm-2)

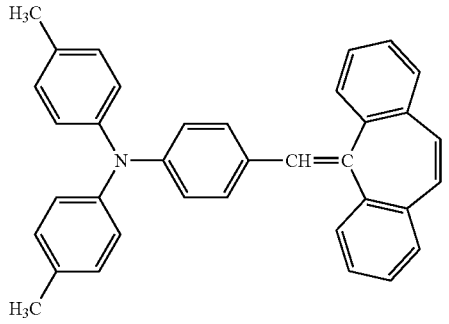

and 10 parts of polycarbonate resin (trade name: EUPILON Z-400; available from Mitsubishi Gas Chemical Company, Inc.) were dissolved in 100 parts of monochlorobenzene to prepare a charge transport layer coating solution. This charge transport layer coating solution was dip-coated on the charge generation layer, and then the wet coating formed was dried at 150° C. for 30 minutes to form a charge transport layer with a layer thickness of 15 μm.

In this way, an electrophotographic photosensitive member of Example 11 was produced.

Example 12

An electrophotographic photosensitive member of Example 12 was produced in the same way as in Example 1 except that, when in Example 1 the charge generation layer coating dispersion was prepared, the hydroxygallium phthalocyanine crystals used, which were those with a crystal form having peaks at 7.5°, 9.9°, 16.3°, 18.6°, 25.1° and 28.3° of the Bragg's angle 2θ±0.2° in CuKα characteristic X-ray diffraction, was changed for oxytitanium phthalocyanine crystals with a crystal form having peaks at 9.0°, 14.2°, 23.9° and 27.1° of the Bragg's angle 2θ±0.2° in CuKα characteristic X-ray diffraction.

Comparative Example 1

An electrophotographic photosensitive member of Comparative Example 1 was produced in the same way as in Example 1 except that, when in Example 1 the charge generation layer coating dispersion was prepared, Exemplary Compound (4) was not used.

Comparative Example 2

An electrophotographic photosensitive member of Comparative Example 2 was produced in the same way as in Example 12 except that, when in Example 12 the charge generation layer coating dispersion was prepared, Exemplary Compound (4) was not used.

Comparative Example 3

An electrophotographic photosensitive member of Comparative Example 3 was produced in the same way as in Example 12 except that, when in Example 12 the charge generation layer coating dispersion was prepared, 0.2 part of Exemplary Compound (4) used was changed for 3 parts of a bisazo pigment represented by the following structural formula.

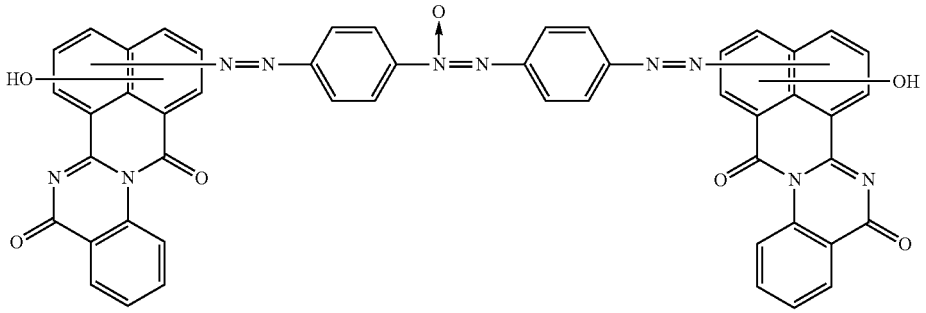

Comparative Example 4

An electrophotographic photosensitive member of Comparative Example 4 was produced in the same way as in Example 1 except that, when in Example 1 the charge generation layer coating dispersion was prepared, Exemplary Compound (4) used was changed for a boron complex represented by the following structural formula.

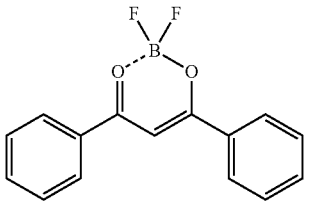

Evaluation of Electrophotographic Photosensitive Members of Examples 1 to 12 and Comparative Examples 1 to 4

Regarding the electrophotographic photosensitive members of Examples 1 to 12 and Comparative Examples 1 to 4, light-area potential was measured and evaluation was made on ghost images. The results of measurement and evaluation are shown in Table 1. Here, in order to make evaluation in a normal-temperature and normal-humidity environment and evaluation in a low-temperature and low-humidity environment, two electrophotographic photosensitive members were readied for each of those of Examples 1 to 12 and Comparative Examples 1 to 4.

A laser beam printer of reverse development system (trade name: LASER JET 4000, manufactured by Hewlett-Packard Co.) was used as an evaluation machine.

Evaluation in Normal-Temperature and Normal-Humidity Environment

Regarding each electrophotographic photosensitive member, first, in a normal-temperature and normal-humidity environment (23° C./55% RH), the light-area potential was measured and evaluation was made on ghost images at the initial stage. Thereafter, under the same environmental conditions, a 1,000-sheet paper feed running test was conducted, and the light-area potential was measured and evaluation was made on ghost images immediately after the paper feed running test and 15 hours after that.

potential was measured and evaluation was made on ghost images immediately after the paper feed running test and 15 hours after that.

The above paper feed running tests were conducted in an intermittent mode of 4-sheet printing per minute and a mode in which a paper feed running-test pattern having lines of about 0.5 mm wide each, lengthwise drawn at intervals of 10 mm, was printed. The light-area potential was measured with a surface potentiometer (Model 1344, manufactured by Trek Japan Corporation).

The evaluation on ghost images was made in the following way.

As a sample for ghost image evaluation, a sample was used in which a pattern of black squares of 5 mm square each was printed by any arbitrary number that corresponds to those for one round of the drum-shaped electrophotographic photosensitive member and then, on the subsequent space of paper, a whole-area halftone image (an image with a dot density of one dot and one space) and a whole-area white image were printed. The sample for ghost image evaluation was also sampled for each development volume of F5 (center value) and F9 (low density) of the machine. Evaluation was visually made and was ranked as shown below, according to the degree of ghost.

Rank 1: Any ghost is not seen at all on any prints.

Rank 2: Ghosts are lightly seen on a specific print (whole-area halftone image).

Rank 3: Ghosts are lightly seen on all prints.

Rank 4: Ghosts are seen on all prints.

Rank 5: Ghosts are clearly seen on all prints.

TABLE 5

| | Evaluation in normal-temperature/ normal-humidity environment | | | | | | Evaluation in low-temperature/ low-humidity environment | | | | | |
|---|---|---|---|---|---|---|---|---|---|---|---|---|
| | Initial stage | | Immediately after running test | | 15 hours after running test | | Initial stage | | Immediately after running test | | 15 hours after running test | |
| | Light = area potential (−V) | Ghost rank | Light = area potential (−V) | Ghost rank | Light = area potential (−V) | Ghost rank | Light = area potential (−V) | Ghost rank | Light = area potential (−V) | Ghost rank | Light = area potential (−V) | Ghost rank |
| Example: | | | | | | | | | | | | |
| 1 | 105 | 1 | 95 | 1 | 95 | 1 | 120 | 1 | 110 | 2 | 120 | 1 |
| 2 | 110 | 1 | 95 | 1 | 95 | 1 | 120 | 1 | 115 | 2 | 120 | 1 |
| 3 | 125 | 1 | 115 | 1 | 115 | 1 | 135 | 1 | 120 | 2 | 130 | 1 |
| 4 | 145 | 1 | 135 | 2 | 135 | 2 | 160 | 2 | 140 | 2 | 150 | 2 |
| 5 | 105 | 1 | 105 | 1 | 110 | 1 | 120 | 1 | 120 | 2 | 120 | 1 |
| 6 | 100 | 1 | 90 | 2 | 95 | 1 | 110 | 1 | 100 | 2 | 100 | 2 |
| 7 | 95 | 1 | 90 | 2 | 95 | 1 | 105 | 1 | 105 | 2 | 105 | 2 |
| 8 | 95 | 1 | 90 | 1 | 95 | 1 | 100 | 1 | 100 | 2 | 100 | 2 |
| 9 | 120 | 2 | 130 | 2 | 125 | 2 | 145 | 2 | 125 | 3 | 125 | 2 |
| 10 | 135 | 2 | 115 | 2 | 125 | 2 | 150 | 2 | 130 | 3 | 140 | 2 |
| 11 | 125 | 1 | 120 | 1 | 125 | 1 | 135 | 1 | 125 | 2 | 135 | 1 |
| 12 | 150 | 1 | 140 | 2 | 145 | 1 | 170 | 2 | 160 | 2 | 165 | 2 |
| Comparative Example: | | | | | | | | | | | | |
| 1 | 110 | 3 | 95 | 4 | 95 | 3 | 120 | 4 | 120 | 5 | 120 | 4 |
| 2 | 155 | 2 | 135 | 4 | 140 | 3 | 180 | 4 | 170 | 5 | 175 | 4 |
| 3 | 165 | 2 | 170 | 4 | 165 | 3 | 185 | 4 | 190 | 5 | 190 | 4 |
| 4 | 110 | 3 | 90 | 4 | 100 | 3 | 110 | 4 | 100 | 5 | 110 | 4 |

Evaluation in Low-Temperature and Low-Humidity Environment

First, each electrophotographic photosensitive member was left to stand for 3 days in a low-temperature and low-humidity environment (15° C./10% RH) together with the evaluation machine. Thereafter, the light-area potential was measured and evaluation was made on ghost images. Then, under the same environmental conditions, a 1,000-sheet paper feed running test was conducted, and the light-area While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2009-189400, filed Aug. 18, 2009, and No.

2010-174522, filed Aug. 3, 2010, which are hereby incorporated by reference herein in their entirety.

What is claimed is:

1. An electrophotographic photosensitive member comprising a support and a photosensitive layer formed on the support, wherein the photosensitive layer contains a charge-generating material and a boron complex, wherein the charge-generating material is an oxytitanium phthalocyanine or a gallium phthalocyanine, and wherein the boron complex is a compound represented by any of the following general formulas (2) to (5):

(2)

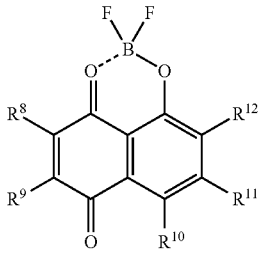

(3)

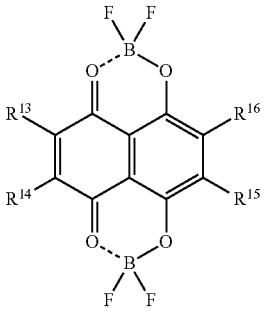

(4)

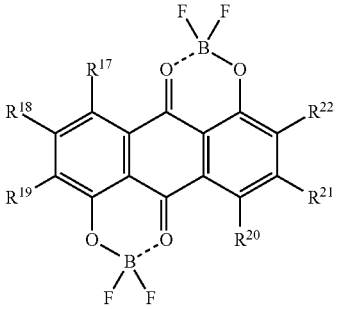

(5)

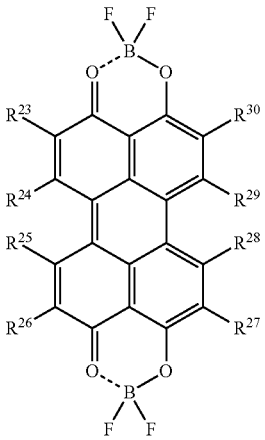

where $R^8$ to $R^{30}$ each independently represent a hydrogen atom, a nitro group, a hydroxyl group, an alkyl group, an alkoxyl group, a phenyl group or a tolyl group; and $R^8$ to $R^{30}$ may combine with another adjacent group among $R^8$ to $R^{30}$ to form a divalent group represented by —CH=CH—CH=CH—.

2. The electrophotographic photosensitive member according to claim 1, wherein the photosensitive layer contains a phthalocyanine pigment as a charge generating material.

3. The electrophotographic photosensitive member according to claim 2, wherein the boron complex in the photosensitive layer is in a content of from 0.5% by mass to 5% by mass based on the charge-generating material.

4. The electrophotographic photosensitive member according to claim 1, wherein the photosensitive layer has a charge generation layer containing the boron complex and a charge-generating material and a charge transport layer containing a charge-transporting material.

5. A process cartridge which integrally supports the electrophotographic photosensitive member according to claim 1 and at least one means selected from the group consisting of:

a charging means for charging the surface of the electrophotographic photosensitive member electrostatically;

a developing means for developing with a toner an electrostatic latent image formed on the surface of the electrophotographic photosensitive member, to form a toner image on the surface of the electrophotographic photosensitive member; and a cleaning means for removing the toner remaining on the surface of the electrophotographic photosensitive member after the toner image has been transferred; and which is detachably mountable to the main body of an electrophotographic apparatus.

6. An electrophotographic apparatus which comprises:

the electrophotographic photosensitive member according to claim 1;

a charging means for charging the surface of the electrophotographic photosensitive member electrostatically;

an imagewise exposure means for exposing to imagewise exposure light the surface of the electrophotographic photosensitive member thus charged, to form an electrostatic latent image on the surface of the electrophotographic photosensitive member;

a developing means for developing with a toner an electrostatic latent image formed on the surface of the electrophotographic photosensitive member, to form a toner image on the surface of the electrophotographic photosensitive member; and a transfer means for transferring to a transfer material the toner image formed on the surface of the electrophotographic photosensitive member.

7. The electrophotographic photosensitive member according to claim 1, wherein the boron complex is a compound represented by any of the general formulas (2), (4), and (5).

8. The electrophotographic photosensitive member according to claim 1, wherein the gallium phthalocyanine is a hydroxygallium phthalocyanine.

* * * * *